United States Patent [19]

Jingu et al.

[11] Patent Number: 4,955,335

[45] Date of Patent: Sep. 11, 1990

[54] CAMSHAFT DRIVING ARRANGEMENT FOR INTERNAL COMBUSTION ENGINE

[75] Inventors: Nobuhisa Jingu, Yokohama City; Yoshio Iwasa, Nagareyama City, both of Japan

[73] Assignee: Nissan Motor Co., Ltd., Yokohama City, Japan

[21] Appl. No.: 450,777

[22] Filed: Dec. 14, 1989

[30] Foreign Application Priority Data

Dec. 22, 1988 [JP] Japan ..... 63-166443[U]

[51] Int. Cl.[5] ..... F01M 9/10

[52] U.S. Cl. ..... 123/90.31; 123/90.33; 123/196 M

[58] Field of Search ..... 123/90.27, 90.31, 90.33, 123/90.34, 90.37, 196 R, 196 M; 184/6.5

[56] References Cited

U.S. PATENT DOCUMENTS

| | | | |
|---|---|---|---|
| 4,121,558 | 10/1978 | Sakakibara et al. | 123/196 R |
| 4,449,487 | 5/1984 | Kruger et al. | 123/196 R |
| 4,607,601 | 8/1986 | Kohler | 123/196 R |
| 4,633,826 | 1/1987 | Tominaga et al. | 123/90.27 |
| 4,677,948 | 7/1987 | Candea | 123/196 R |
| 4,729,348 | 3/1988 | Okada et al. | 123/90.31 |
| 4,750,455 | 6/1988 | Ebesu | 123/90.31 |
| 4,827,881 | 5/1989 | Baker et al. | 123/196 R |

FOREIGN PATENT DOCUMENTS

| | | |
|---|---|---|
| 3713849 | 1/1988 | Fed. Rep. of Germany . |
| A669709 | 2/1929 | France . |
| 2464364 | 6/1981 | France . |
| 0050208 | 3/1985 | Japan . |

*Primary Examiner*—David A. Okonsky
*Assistant Examiner*—Weilun Lo
*Attorney, Agent, or Firm*—Pennie & Edmonds

[57] ABSTRACT

A camshaft driving arrangement for an internal combustion engine comprises a cylinder head formed with a cam chamber, and an idler chamber communicating with an oil pan and an end face of the cylinder head. The end face includes openings allowing communication between the cam chamber and the idler chamber. An idler shank is fixedly mounted on the cylinder head. An idler sprocket is rotatably supported on the idler shank, and includes a radial portion disposed adjacent the end face. The end face, the radial portion, and the idler shank cooperate with each other to define a passage allowing oil flowing out of the cam chamber via the openings to flow down toward the oil pan.

6 Claims, 4 Drawing Sheets

CAMSHAFT DRIVING ARRANGEMENT FOR INTERNAL COMBUSTION ENGINE

BACKGROUND OF THE INVENTION

The present invention relates to a camshaft driving arrangement for an internal combustion engine.

Japanese Provisional Patent Publication No. 60-50208 discloses a known double overhead camshaft (DOHC) type internal combustion engine for an automotive vehicle where a drive sprocket coupled to a crankshaft is arranged at the lower portion on the front end of a cylinder block, and two camshafts in a cam chamber arranged at the upper end portion on the front end wall of a cylinder head. The camshafts are provided with cams for intake and exhaust valves. Cam sprockets are fixdely coupled to the camshafts at the ends thereof. An idler chamber is defined by an end wall of the cylinder head and a chain cover arranged below the cam sprockets. In the idler chamber, an idler sprocket with large and small diameter portions is rotatably supported by a bearing which is mounted to the cylinder head on the end wall thereof. Two endless timing chains are provided, one drivingly interconnecting the idler sprocket and the drive sprocket, the other interconnecting the idler sprocket and the cam sprocket.

In the known DOHC type internal combustion engine, a large amount of lubrication oil is supplied to slide portions of each of valve actuating mechanisms such as a cam journal and a hydraulic rush adjuster. To provide adequate supply of lubrication oil to the other slide portions of the engine, it is necessary that a constant amount of lubrication oil be always stored in an oil pan. Accordingly, it is desirable that the large amount of lubrication oil which has been supplied to the valve actuating mechanisms return quickly to the oil pan.

With such conventional camshaft driving arrangement, a partition wall separates the cam chamber where lubrication oil is temporarily stored from the idler chamber in fluid communication with the oil pan. For allowing lubrication oil within the cam chamber to return to the oil pan, return ports small in diameter are formed through the upper and lower portions of the cylinder head and cylinder block. With this oil flow arrangement, during operation of the engine, the amount of lubrication oil returning to the oil pan during a predetermined period of time is not sufficiently great, thus causing a reduction in storage of oil in the oil pan. This causes poor lubrication on the slide portions of the engine.

Let us now consider an attempt to form an opening through the end wall of the cylinder head for allowing communication of the cam chamber with the idler chamber so as to allow return of lubrication oil from the cam chamber to the oil pan by way of the idler chamber. In this event, if the idler sprocket is located at a portion lower than the opening is, lubrication oil flows out of the opening, and sticks to the outer peripheries of the large and small diameter portions of the idler sprocket. The stuck oil is splashed intensively owing to rotation of the idler sprocket, causing an increase in amount of oil entrained in the blow-by gas and an increased oil consumption.

An object of the present invention is to provide a camshaft driving arrangement for an internal combustion engine which assures excellent recovery of the lubrication oil to the oil pan and prevents splashing of the oil owing to rotation of the idler sprocket.

SUMMARY OF THE INVENTION

There is provided, according to the present invention, in an internal combustion engine:

a cylinder block including a cylinder bank;

a cylinder head mounted on said cylinder bank and having an end face, said cylinder head being formed with a cam chamber;

an oil pan storing a lubrication oil;

said cylinder head being formed with an idler chamber communicating with said oil pan and wall means defining said idler chamber, said wall means including said end face;

said end face including a predetermined portion formed with at least one opening allowing communication between said cam chamber and said idler chamber;

an idler shank fixdely mounted on the cylinder head and projecting out of said end face into said idler chamber;

an idler sprocket rotatably supported on said idler shank and disposed in said idler chamber, said idler sprocket including a radial portion disposed adjacent said end face and extending in the vicinity of said predetermined portion;

said end face of said cylinder head, said radial portion of said idler sprocket, and said idler shank cooperating with each other to define a passage allowing oil flowing out of said cam chamber via said opening to flow therethrough down toward said oil pan.

BRIEF DESCRIPTION OF THE DRAWINGS

FIG. 2 is a fragmentary front view illustrating a cylinder head portion which the first embodiment is applied to;

DETAILED DESCRIPTION OF THE INVENTION

Figure 1:
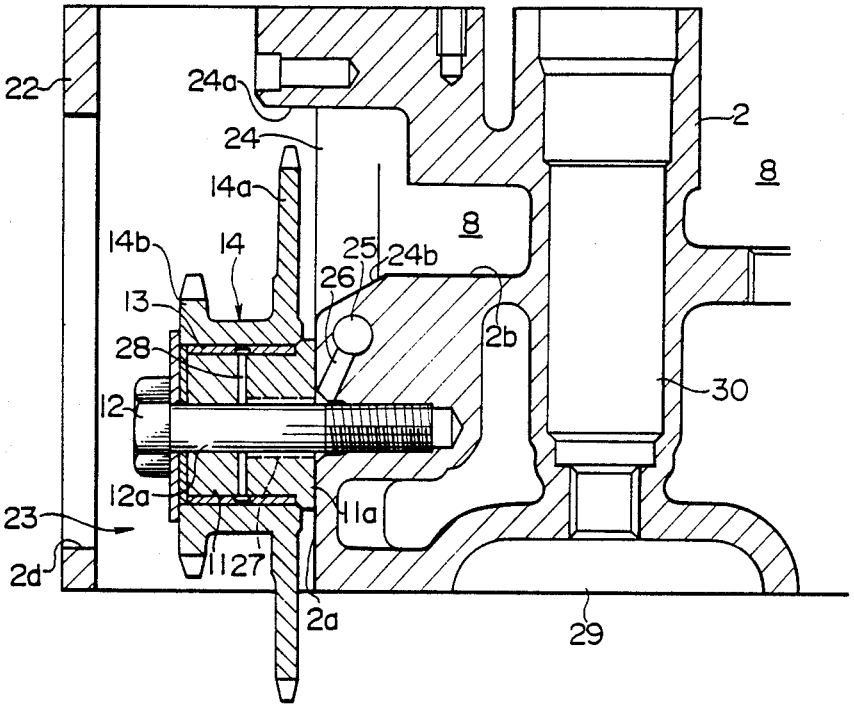
FIG. 1 is a fragmentary sectional view illustrating a first embodiment of a camshaft driving arrangement for an internal combustion engine according to the present invention.
Figure 2:
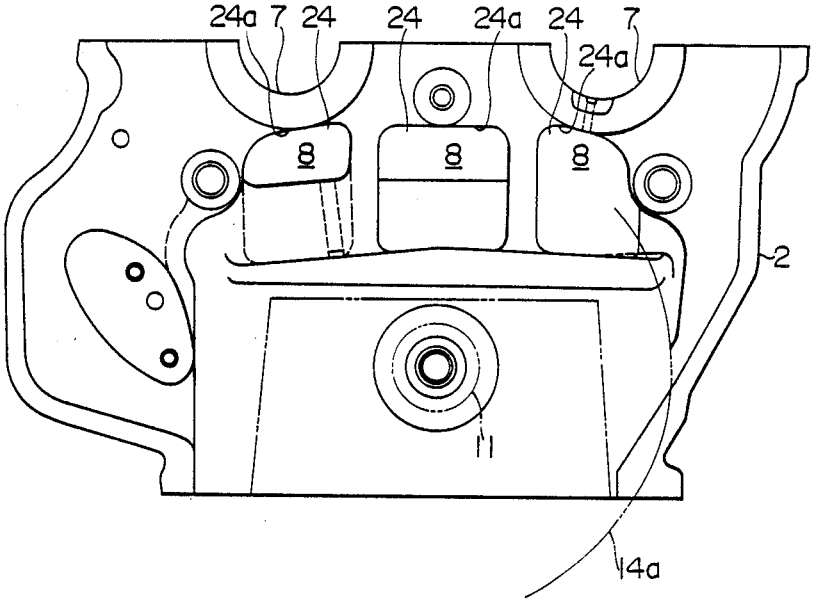
Figure 3:
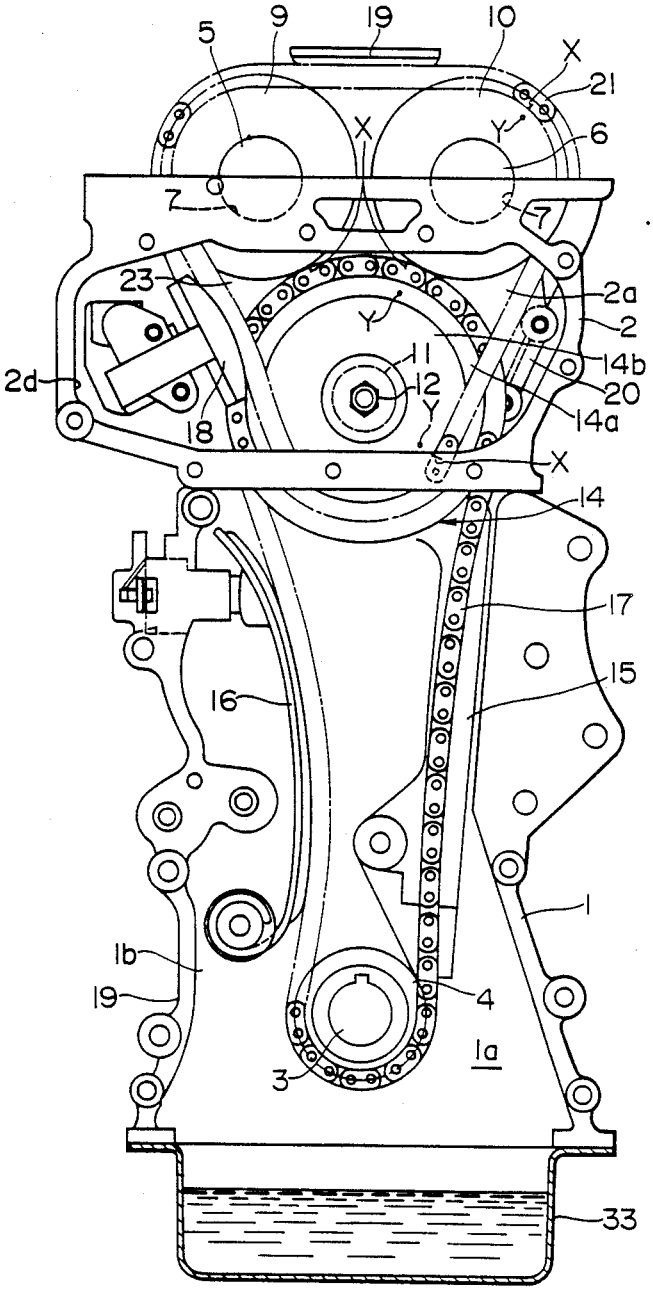
FIG. 3 is a front view illustrating a double overhead camshaft type engine.

Referring to FIG. 3, there is shown a double overhead camshaft (DOHC) type internal combustion engine which a first embodiment of a camshaft driving arrangement is applied to. In FIG. 3, a reference numeral 1 designates a cylinder block, 2 a cylinder head mounted on the cylinder block 1, and 3 a crankshaft which has a portion protruded from a front end face **1*b* of a crank case 1*a* of the cylinder block 1. A drive sprocket 4 is mounted to the crankshaft 3 at the protruded end thereof. Two camshafts 5 and 6 are rotatably supported by two cam bearings 7 formed on the cylinder head 2, and are disposed in a cam chamber 8 which an upper deck 2*b* of the cylinder head 2 is formed with as shown in FIGS. 1 and 2. Two cam sprockets 9 and 10 are fixdely coupled with the camshafts 5 and 6 at their ends which are protruded from the front end face 2*a* of the cylinder head 2**. To the lower portion of the front end face 2a of the cylinder head 2, an idler shank 11 is fixdely mounted by means of a mounting bolt 12 on the cylinder head 2 and protruding out of the front end face 2a into an idler chamber 23 defined between an idler chamber wall 22 and the front end face. An idler sprocket 14 is rotatably mounted to the idler shank 11 by way of a bearing 13. The idler sprocket 14 includes an inner large diameter portion 14a and an outer small diameter portion 14b. The large diameter portion 14a has teeth twice as many as the number of teeth of the drive sprocket 4, so that it rotates at a speed one half the rotational speed of the crankshaft 3. As shown in FIG. 3, a crank side chain 17 drivingly interconnects the large diameter portion 14a and the drive sprocket 4. The chain 17 has one side supported by a chain guide 15 and the other side by a movable chain tensioner 16. On the other hand, a cam chain 21 drivingly interconnects the small diameter portion 14b and the two cam sprockets 9 and 10, whose tension is kept constant by a chain tensioner 18 and chain guides 19 and 20. To cover the chains 17 and 21, the idler chamber wall 22 is monolithically formed on the cylinder head 2 in a spaced relationship with the front end face 2a of the cylinder head 2 to define therebetween the idler chamber 23. The idler chamber 23 receives the idler sprocket 14. The idler chamber 23 communicates with an oil pan 33 via a clearance defined between the front end face 1b of the crank case 1a and a chain case (not shown).

As best seen in FIG. 2, the front end wall 2a of the cylinder head 2 includes a predetermined apertured portion formed with three openings 24 for allowing communication of the cam chamber 8 with the idler chamber 23. The cam chamber 8 is defined by wall means including an upper wall 24a and a lower wall 24b which define the outer periphery of each of the openings 24 as best seen in FIGS. 1 and 2. As best seen in FIG. 1, the lower wall 24b is so inclined as to direct oil toward the idler shank 11 past the corresponding opening 24. As best seen in FIG. 1, the large diameter portion 14a extends in the vicinity of the predetermined apertured portion in such a manner as to conceal the openings 24 (see FIGS. 2 and 3 also). The idler sprocket 14 is so constructed and arranged that the idler shank 11, fixdely mounted to the front end face 2a, is disposed substantially below the openings 24.

In FIG. 1, a reference numeral 25 designates an oil gallery. Lubrication oil flowing into the oil gallery 25 goes from an inclined oil passage 26 disposed in the cylinder head 2 to an annular oil supply passage 27 formed around an outer periphery of a shank 12a of the mounting bolt 12. Then, it goes through a passage 28 radially formed to the idler shank 11, and is supplied to the inner periphery of the bearing 13. A reference numeral 29 designates a combustion chamber, and 30 an ignition plug hole.

Next, the operation of this embodiment will be described.

During operation of the engine, lubrication oil within the oil pan 33 effects lubrication between valve actuating mechanisms or between the camshafts 5 and 6 and the cam bearings 7, or acts as a hydraulic fluid in a hydraulic rush adjuster, and then flows from the cam chamber 8 to the idler chamber 23 past the openings 24. Due to the provision of the inclined lower wall 24b adjacent to each of the openings 24, the oil is guided and directed toward the idler shank 11. Referring to FIG. 1, the end face 2a of the cylinder head 2, the inner peripheral portion of the large diameter portion 14a, and the outer periphery of the idler shank 11 cooperates with each other to define a passage out of the cam chamber 8 via the openings 24 to flow therethrough down toward the oil pan 33.

Specifically, the oil flows along the periphery of a fixed end portion 11a of the idler shank 11 and along the front end face 2a of the cylinder head 2, and then drops quickly into the oil pan 33 along the front end face 1b of the cylinder block 1. In this event, the idler shank 11, which is fixed, does not interfere with smooth flow of the oil. As described above, since the oil out of the openings 24 drops down without sticking to the outer peripheral portion of the idler sprocket 14 having a high peripheral speed, the oil is prevented from splashing owing to rotation of the idler sprocket 14. This results in not only an increased recovery of lubrication oil to the oil pan 33, but a restricted amount of oil which is contained in a blow-by gas.

Figure 4:
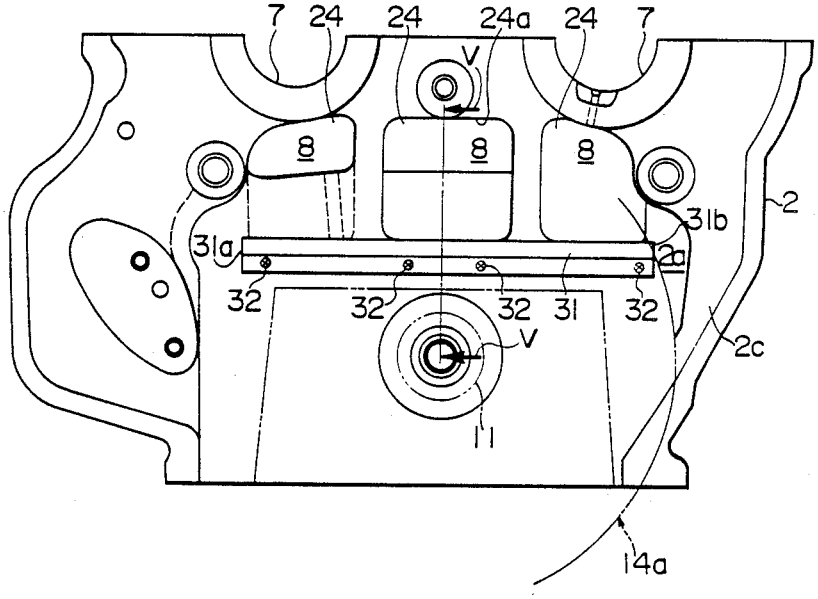
FIG. 4 is a view similar to FIG. 2 but illustrating a second embodiment of a camshaft driving arrangement for an internal combustion engine according to the present invention.
Figure 5:
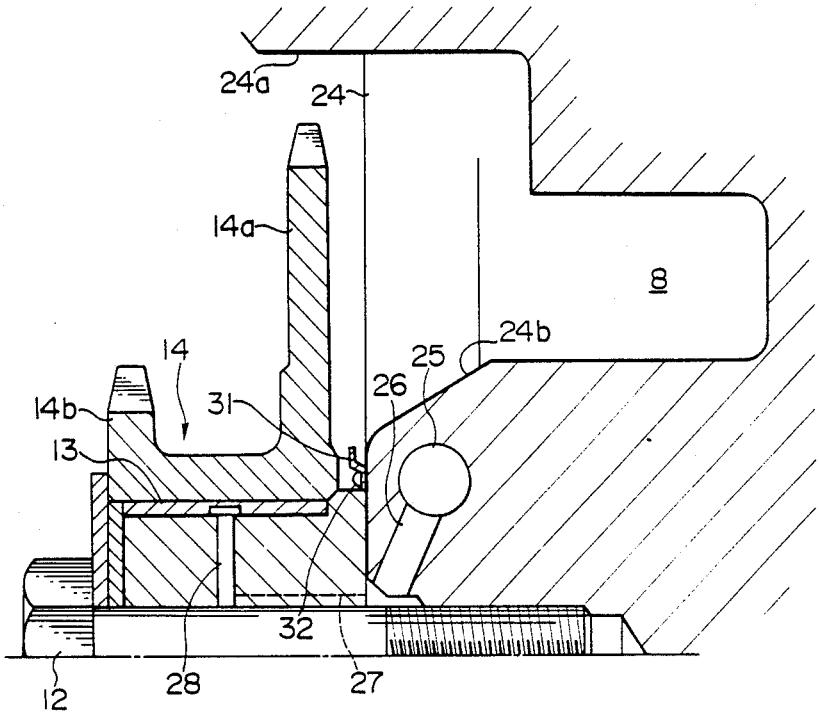
FIG. 5 is a sectional view taken along the line V—V of FIG. 4.

Referring to FIGS. 4 and 5, there is shown a second embodiment of the present invention. In this embodiment, there is provided, between the lower wall 24b and the idler shank 11, an oil guide 31 in the form of a gutter across the cylinder head 2. The gutter 31, whose length is somewhat shorter than the large diameter portion 14a, is formed by cranking a long and narrow plate, and it is fixdely mounted by means of bolts 32 to the front end face 2a of the cylinder head 2 which is located right below the lower wall 24.

Accordingly, in this embodiment, the lubrication oil, which flows from the cam chamber 8 to the idler chamber 23 as being guided by the lower wall 24b, is collected by the gutter 31. Then, it runs in either of its longitudinal directions along a lateral wall 2c, and flows down along the front end face 2a of the cylinder head 2. In this manner, the gutter 31 prevents the oil running out of the openings 24 from flowing down on the idler shank 11 of the idler sprocket 14. Thus, it is possible to separate the flow of oil from the idler sprocket 14, resulting in an increased recovery of lubrication oil to the oil pan 33. In this embodiment, the large diameter portion 14a of the idler sprocket 14 is arranged to conceal the openings 24 in a similar manner to the first embodiment. Alternatively, the idler sprocket 14 may be arranged not to conceal the openings 24.

In each of the embodiments, the oil supply passage 27 disposed between the inclined oil passage 26 and the bearing 13 is formed not along the inner shaft of the mounting bolt 12 but around the outer periphery of the shank 12a. This allows the use of the mounting bolt 12 of the ordinary type, and the rigidity of the mounting bolt 12 to be preserved, resulting in the maximally reduced outer diameter of the shank 12a.

The large diameter portion 14a is disposed on the side of the front end face 2a, so that it is easy to align timing marks X of the chains 17 and 21 with timing marks Y of the large and small diameter portions 14a and 14b by way of the opening 2d which is tightly closed by means of a cover (not shown).

What is claimed is:

1. In an internal combustion engine:

a cylinder block including a cylinder bank;

a cylinder head mounted on said cylinder bank and having an end face, said cylinder head being formed with a cam chamber;

an oil pan storing a lubrication oil;

said cylinder head being formed with an idler chamber communicating with said oil pan and wall means defining said idler chamber, said wall means including said end face;

said end face including a predetermined portion formed with at least one opening allowing communication between said cam chamber and said idler chamber;

an idler shank fixedly mounted on the cylinder head and projecting out of said end face into said idler chamber;

an idler sprocket rotatably supported on said idler shank and disposed in said idler chamber, said idler sprocket including a radial portion disposed adjacent said end face and extending in the vicinity of said predetermined portion;

said end face of said cylinder head, said radial portion of said idler sprocket, and said idler shank cooperating with each other to define a passage allowing oil flowing out of said cam chamber via said opening to flow therethrough down toward said oil pan.

2. An internal combustion engine as claimed in claim 1, wherein said idler sprocket includes an inner large diameter portion as said radial portion, and an outer small diameter portion remote from said end face with respect to said inner large diameter portion.

3. An internal combustion engine as claimed in claim 2, wherein said inner large diameter portion of said idler sprocket conceals said predetermined portion.

4. An internal combustion engine as claimed in claim 1, wherein said cam chamber includes a lower wall so inclined as to direct oil toward said shank portion past said opening.

5. An internal combustion engine as claimed in claim 3, further comprising:

means for guiding oil flowing out of said cam chamber in such a manner as to prevent said oil from contacting with said idler shank.

6. An internal combustion engine as claimed in claim 4, wherein an oil guide member is in the form of a gutter mounted on said end face above said idler shank and below said predetermined portion.

* * * * *